US007293486B2

(12) United States Patent
Chang

(10) Patent No.: US 7,293,486 B2
(45) Date of Patent: Nov. 13, 2007

(54) STRUCTURE OF A SCREW NAILER

(75) Inventor: Shin-Nan Chang, Taichung (TW)

(73) Assignee: Basso Industry Corp., Taichung (TW)

( * ) Notice: Subject to any disclaimer, the term of this patent is extended or adjusted under 35 U.S.C. 154(b) by 115 days.

(21) Appl. No.: 11/175,232

(22) Filed: Jul. 7, 2005

(65) Prior Publication Data

US 2006/0112795 A1 Jun. 1, 2006

Related U.S. Application Data

(63) Continuation-in-part of application No. 11/001,394, filed on Dec. 1, 2004, now Pat. No. 7,121,174.

(51) Int. Cl.
*B25B 23/04* (2006.01)
*B25B 23/06* (2006.01)
*B25B 21/00* (2006.01)

(52) U.S. Cl. ..... 81/434; 81/57.37

(58) Field of Classification Search ..... 81/434, 81/435, 57.37

See application file for complete search history.

(56) References Cited

U.S. PATENT DOCUMENTS 4,059,034 A * 11/1977 Hornung ..... 81/57.37
5,083,483 A * 1/1992 Takagi ..... 81/434
5,138,913 A * 8/1992 Chen ..... 81/434
5,687,624 A * 11/1997 Tsuge et al. ..... 81/439
5,899,126 A * 5/1999 Fujiyama et al. ..... 81/434
7,121,174 B2 * 10/2006 Lai et al. ..... 81/434

* cited by examiner

*Primary Examiner*—David B. Thomas
(74) *Attorney, Agent, or Firm*—Egbert Law Offices

(57) ABSTRACT

The structure of a screw nailer includes a body with a functional space inside; a rotary driver, placed in the functioning space rotated from a point of support and having a gear wheel that moves the nail belt; a one-way driving component moving the rotary driver in a single direction; an indexing fixer creating elastic positioning when the rotary driver turns in a direction in a preset angle, so that the rotary driver achieves the indexing positioning. A blockage fixer, and by position of the blockage fixer to nail the screw by rotational inertia when the rotary driver of the screw nailer is rotating in direction with preset angle to keep the nail belt from turning the angles, so that the screws may be nailed accurately and securely to the designated location, and largely increase the accuracy, quality and effects of the screw nailer operation.

6 Claims, 9 Drawing Sheets

STRUCTURE OF A SCREW NAILER

RELATED U.S. APPLICATIONS

The present application is a continuation-in-part of U.S. patent application Ser. No. 11/001,394, filed on Dec. 1, 2004, and entitled "SCREW-FEEDING DEVICE FOR A SCREW-DRIVING TOOL", now U.S. Pat. No. 7,121,174, issued on Oct. 17, 2006.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a screw nailer, and more particularly to a new device, which can nail the screw accurately to the designated location by adding a blockage fixer, so that when the rotary driver of the screw nailer is rotating in one angle, the screw can be nailed by its rotational inertia to prevent the nail belt from skipping.

BACKGROUND OF THE INVENTION

The screw nailer is an assisting device that can be installed on the end of pneumatic or electrical tool, and it is designed to move the screws along the process, so that operators do not have to hold the screws, which makes it safer, more effective and labor-saving.

Please see FIGS. 1-2 for the conventional structure of this screw nailer, which comprises a body 10, a driving wheel 11, a one-way bearing 12, a guide driving rod 13 and a snap 14; please see FIG. 2 for its operation, when the guide driving rod 13 is driven and turning, it moves the one-way bearing 12 along, and the one-way bearing turns the driving wheel 11 in one direction in a path with preset angle, at this time, the coiled wedge end 141 of the snap 14 mentioned above is locked in the fixation slot 112 formed between the protruding blocks 111 after an elastic recoil is created when it moves along the protruding block 111 on the driving wheel 11; when this move is completed, it would also moves the nail belt 15 by moving the protruding teeth 113 of the driving wheel 11 synchronously; except, this convention structure still has the following issues existed in practical application.

Because when the nail belt 15 moves, the fixed position is achieved by locking the coiled wedge end 141 of the snap 14 in the fixation slot 112 of the driving wheel 11; however, after the snap 14 has been used for a while, it may become crooked and cause elastic fatigue, thus, the stability and endurance of the snap's locking movement becomes gradually degenerated and could not meet the requirement, and "over-turn" appears at the end of each turn of the driving wheel 11, which causes the driving wheel 11 to fail to position the nail belt 15 in the designated location, so that it is easy to nail the screws, which are on the nail belt, to the wrong position, and this affects the coming nailing movement, because slightly dispositioned nail can easily cause the nailing target to look crooked, and further affect its quality besides it may disrupt the process of nail positioning.

Thus, to overcome the aforementioned problems of the prior art, it would be an advancement if the art to provide an improved structure that can significantly improve the efficacy.

To this end, the inventor has provided the present invention of practicability after deliberate design and evaluation based on years of experience in the production, development and design of related products.

BRIEF SUMMARY OF THE INVENTION

Constructed through above, the present invention mainly adds the blockage fixer 70, and by the position of the blockage fixer to nail the screw by its rotational inertia when the rotary driver of the screw nailer is rotating in the direction with preset angle to keep the nail belt 40 from turning the angles, so that the screws may be nailed accurately and securely to the designed location; this way, it indeed solves the problem of the conventional screw nailer, in which the nail belt is unable to secure the position and seriously affects the nailing operation; this invention has largely increase the accuracy, quality and effects of the screw nailer operation, and is practical and preferred application.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
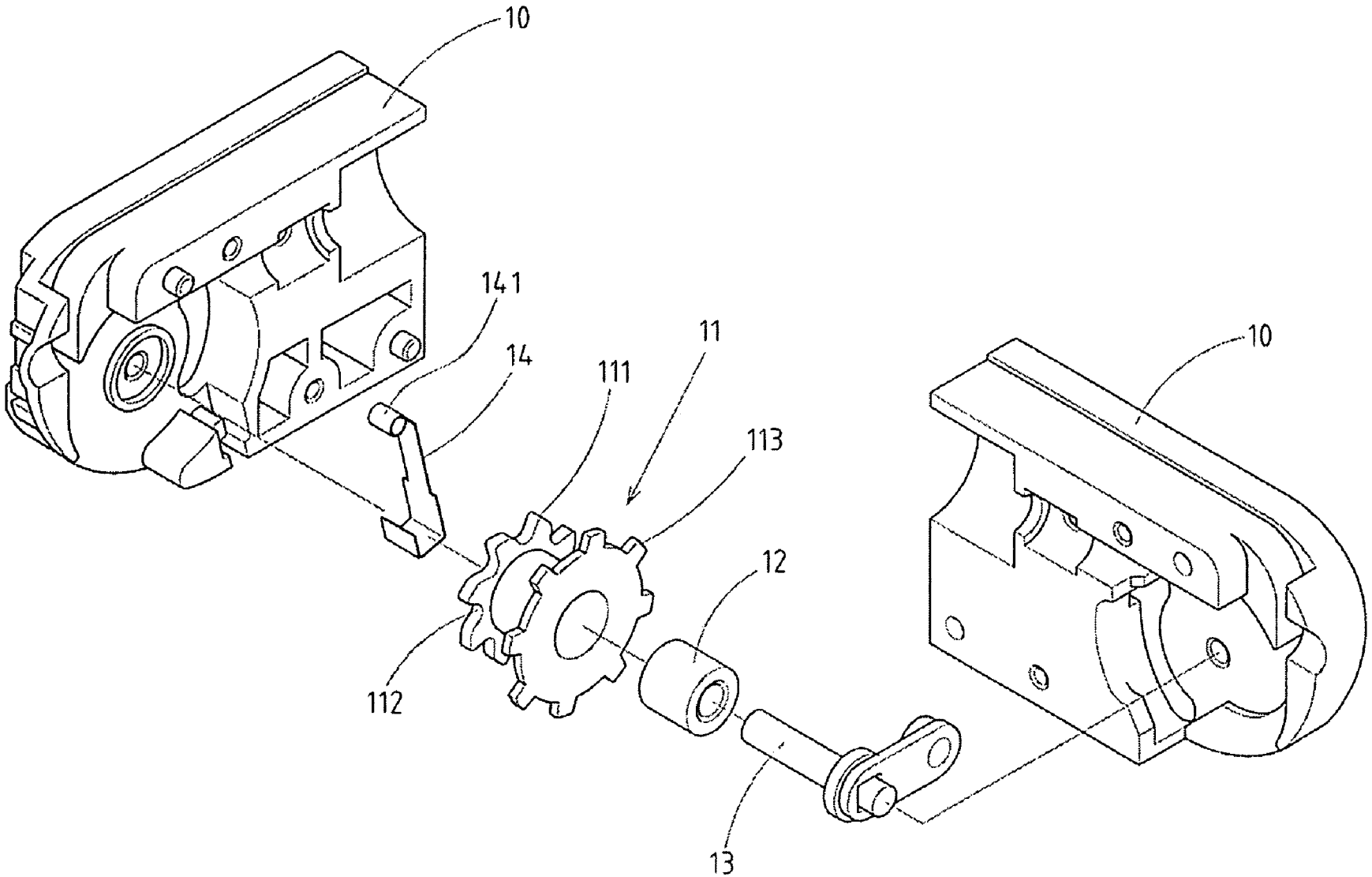
FIG. 1 shows an exploded perspective view of the conventional screw nailer.
Figure 2:
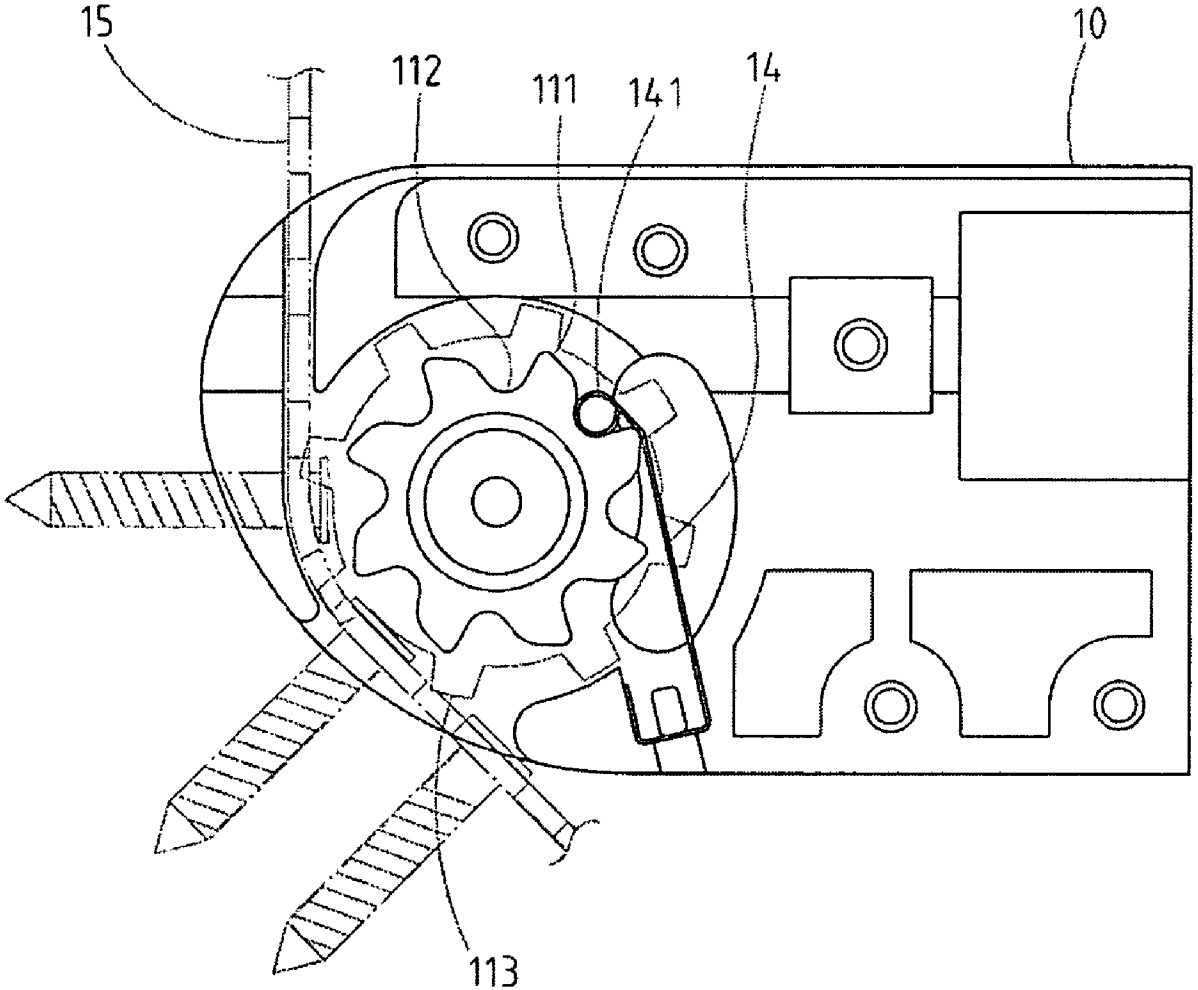
FIG. 2 shows a sectional view of the operating of the conventional screw nailer.
Figure 3:
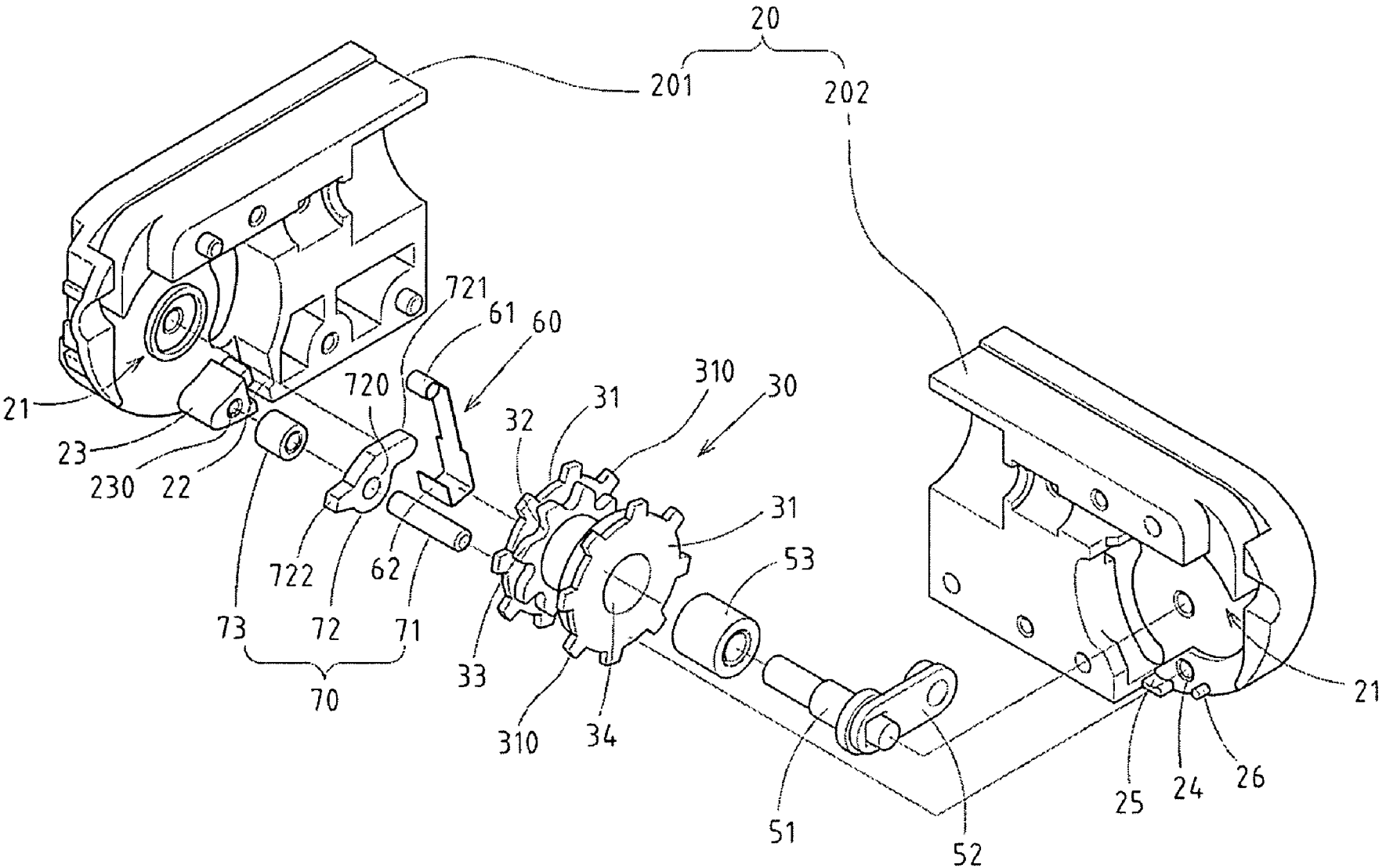
FIG. 3 shows an exploded perspective view of a preferred embodiment of the present invention.

As shown in FIGS. 1-3, there is a preferred embodiment of the present invention.

The invention includes a body 20, which consists of two block-shaped components 201 202 setting correspondingly;

and a functioning space 21 is formed inside after both of them are put together; among them, a fixation slot 22 and a protruding block 23 are placed inside a module 201, and a pivotal hole 230 is placed on the protruding block, and a pivotal hole 24, are protrusion 25 and a fixation column 26 are placed on the corresponding site on the other module.

There is a rotary driver 30, which is made gear like, is to be placed in the functioning space 21 of the body 20, so that it may rotate from a fixed point; the rotary driver 30 consists of two gear wheels for the nail belt 40, and several fixation rims 32 on the inner side of gear wheel, and the fixation rim is formed by the inverse slot between the arc block 33; and an axial hole 34 is in the center of the rotary driver 30.

A one-way driving component 50 includes a guide rod 51, an oscillation component 52 and an one-way bearing 53, and among them, the inside of the hole of an oscillation component 52 is placed on the outside of the guide rod 51, and the outside of the one-way bearing 53 is placed inside the axial hole 34 of the rotary driver 30 mentioned above, and the oscillation component 52 is linked vertically to one end of the guide rod 51; and by so doing, the guide rod 51 can drive the rotary driver 30 in a single direction and make the oscillation component 52 move in the direction with preset angle synchronously.

An indexing fixer 60 has an elastic wedge end 61 that can be locked in the fixation rim 32 when the rotary driver 30 is moving in a direction with a preset angle to achieve the purpose of indexing and positioning; the indexing fixer 60 in the embodiment is a L-shaped snap, and one end is coiled that shaped elastic wedge end 61, and the other end is a hook end 62 that can be hooked to the fixation slot 22 of the body 20.

There is a blockage fixer 70, which is to be driven by the oscillating movement of the oscillation component of the one-way driving component mentioned earlier, and when the rotary driver is rotating in one angle, the screw can be nailed by its rotational inertia to prevent the rotary driver from turning angle; the blockage fixer of the present embodiment includes a pivotal column 71, a fixation block 72 and a cylinder bearing 73; among them, the pivotal column 71 is connected between two pivotal holes 230 24 on the body 20, and the fixation block 72 is hooked to the pivotal column 71 by a through hole 720, so that the cylinder bearing 73 is connected to the pivotal column 71 and formed a limited position on one side of fixation block 72; and the fixation block 72 is located on one side of rotary driver 30 that is rotatable, and it has a first protruding fastener 721 and the second protruding fastener 722, and among them, the first protruding fastener 721 is against the oscillation component 52 of the one-way driving component 50 while it is oscillating to make the second protruding fastener 722 pushed against the protruding teeth 310 on the gear wheel 31 of the rotary driver 30, this way, it can be nailed by its rotational inertia to prevent the rotary driver from turning angles.

Through the above structure and design, the operation of the present invention disclosed is explained as follows.

Figure 4:
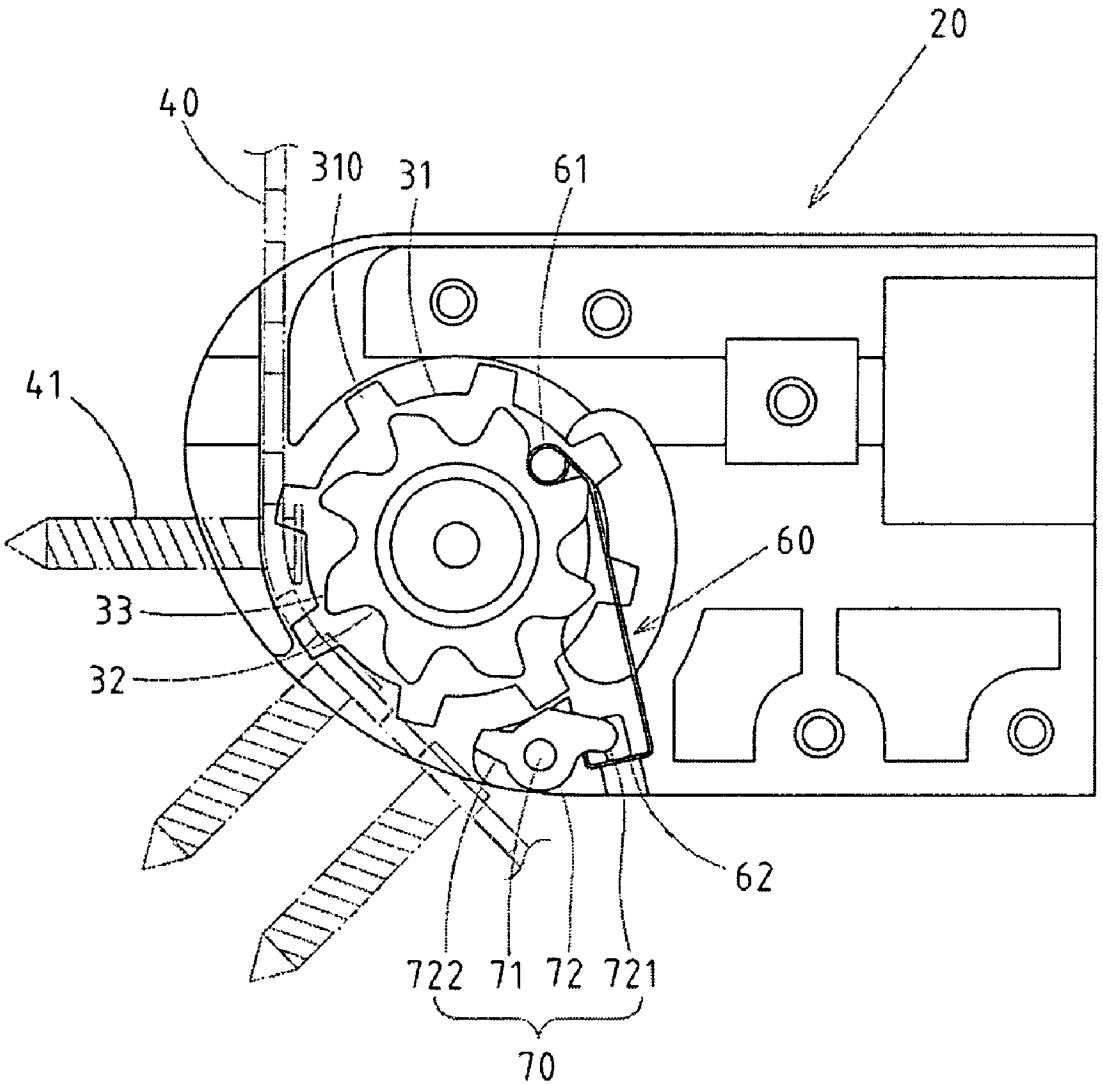
FIG. 4 shows a sectional view of the inner structure of the preferred embodiment of the present invention.
Figure 5:
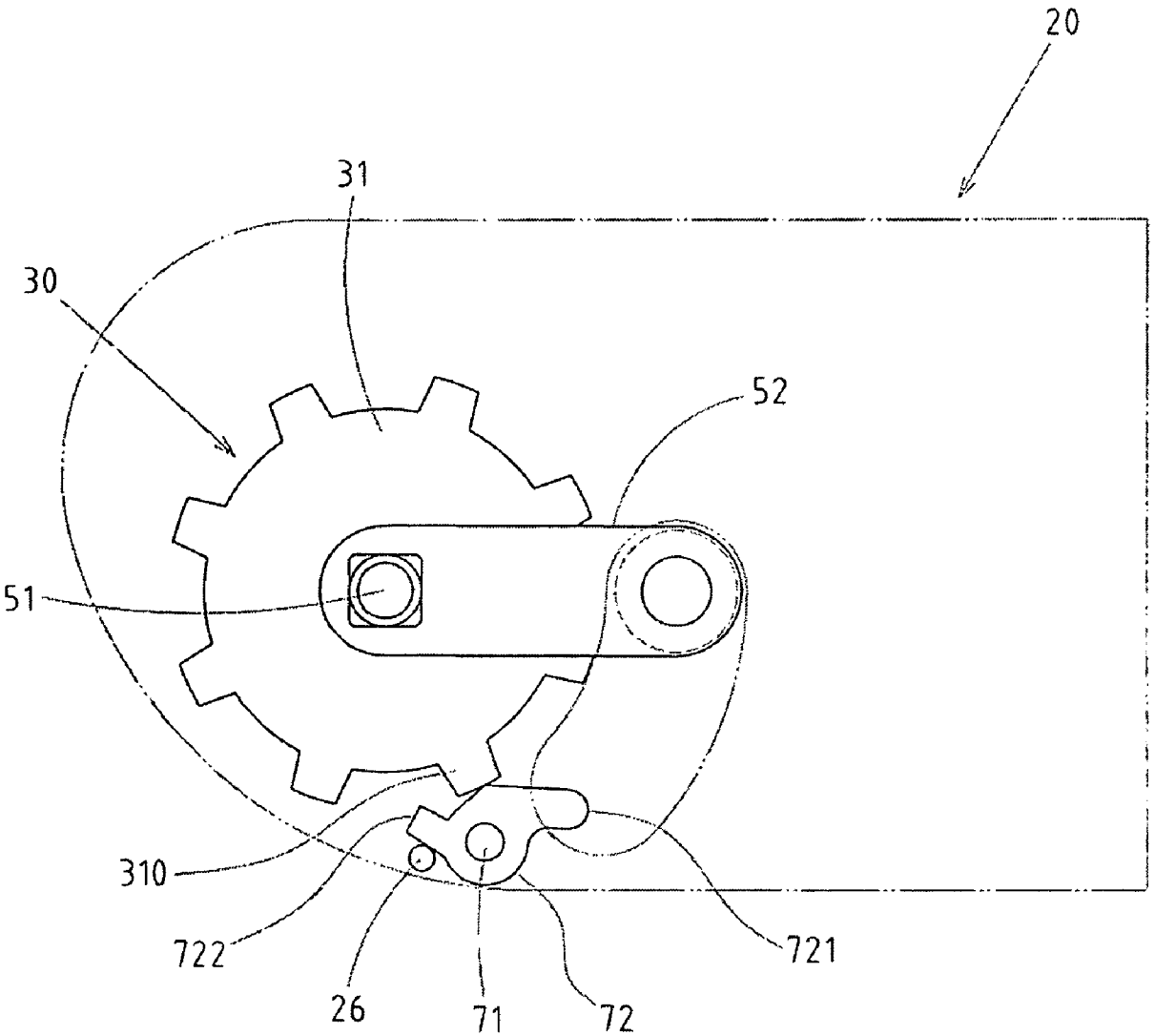
FIG. 5 shows a schematic view of the oscillation component of the present invention before movement.
Figure 6:
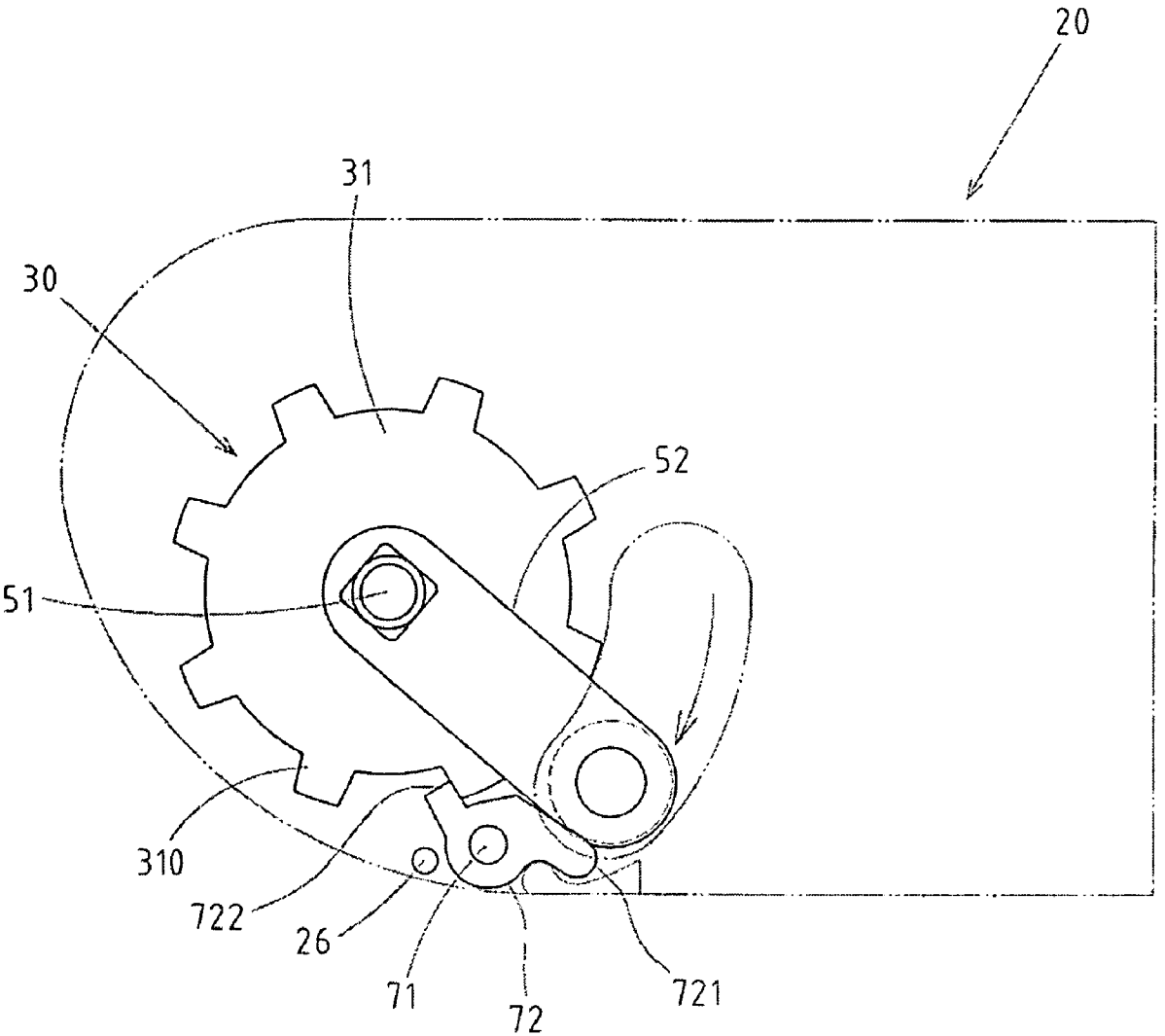
FIG. 6 shows a schematic view of the oscillation component of the present invention with pushing movement.

As shown in FIGS. 5 and 6, when the guide rod 51 of one-way driving component 50 is being driven, it can move the one-way bearing 53, and the one-way bearing moves rotary driver 30 in a single direction, so that the gear wheel 31 and fixation rim 32 on the rotary driver rotates synchronously (as seen in the picture), and at this time, the elastic wedge end 61 on the indexing fixer 60 first is pushed against the arc block 33 of the rotary driver 30, and then recoiled, and is locked in the fixation rime 32, so that the rotary driver 30 is positioned by a single movement, one the other hand, the oscillation component 52 of the one-way driving component 50 is oscillated against the top of the first protruding fastener 721 of the fixation block 72, the rotation of the first protruding fastener 72 is limited because it is blocked by the arc protrusion 25 of the body 20, meanwhile, the position of the second protruding fastener 722 of the fixation block 72 is pushed against one of the protruding teeth 310 on the gear wheel 31, and by so doing, it keeps the oscillation component 52 of the one-way driving component 50 from oscillating, at the same time, it completes a moving process of the nail belt 40 on the rotary driver 30, so that the screw 41 is nailed to the designated position (please FIG. 4), and the coming nailing process continues.

Moreover, when the second protruding fastener 722 of the fixation block 72 is driven by the protruding teeth 310 of the gear wheel 31, it can be positioned by the blockage of the fixation column that is placed on the body 20 to prevent the fixation block 72 from over turning. (As shown in FIG. 5).

Figure 7:
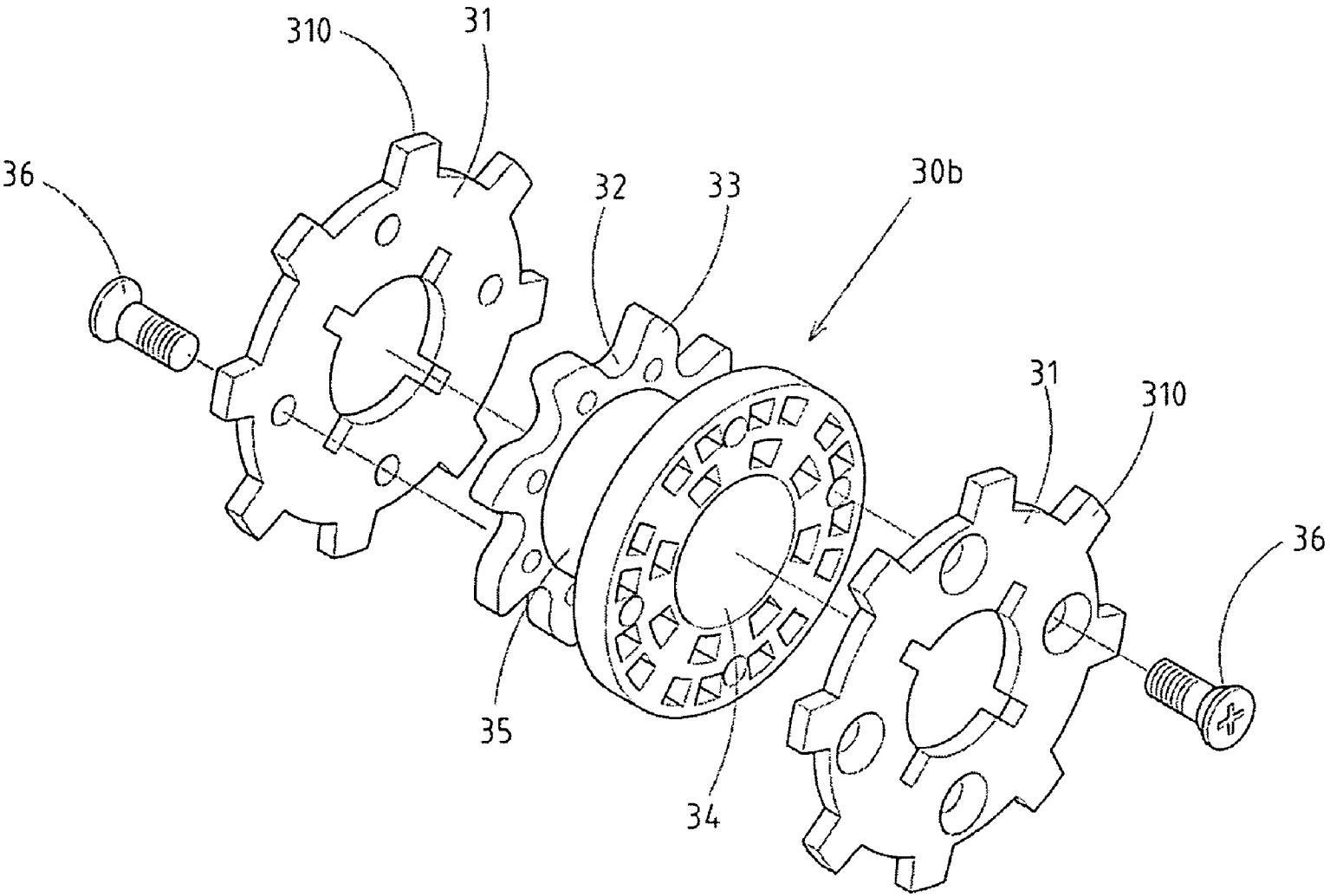
FIG. 7 shows an exploded perspective view of the embodiment of the structure of the rotary driver of the present invention.

FIG. 7 shows the embodiment of the assembled structure of the rotary driver 30B, among them, the fixation rim 32 and arc block 33 formed the main gear body 35 that has an axial hole 34, and two gear wheels are connected to both sides of the main gear body 35 separately; and the rotary driver 30B made by these parts can coordinate with the movements of indexing fixer 60 and blockage fixer 70 to achieve the same effect.

Figure 9:
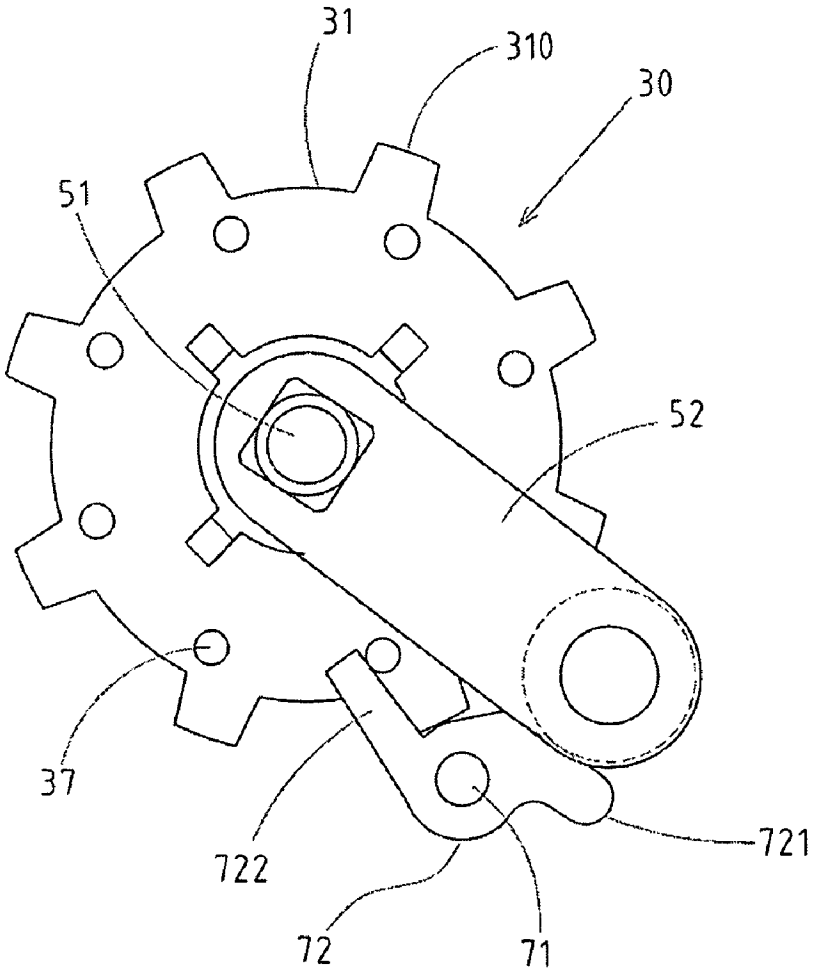
FIG. 9 shows a lateral elevation view of the structure disclosed in FIG. 8.
Figure 8:
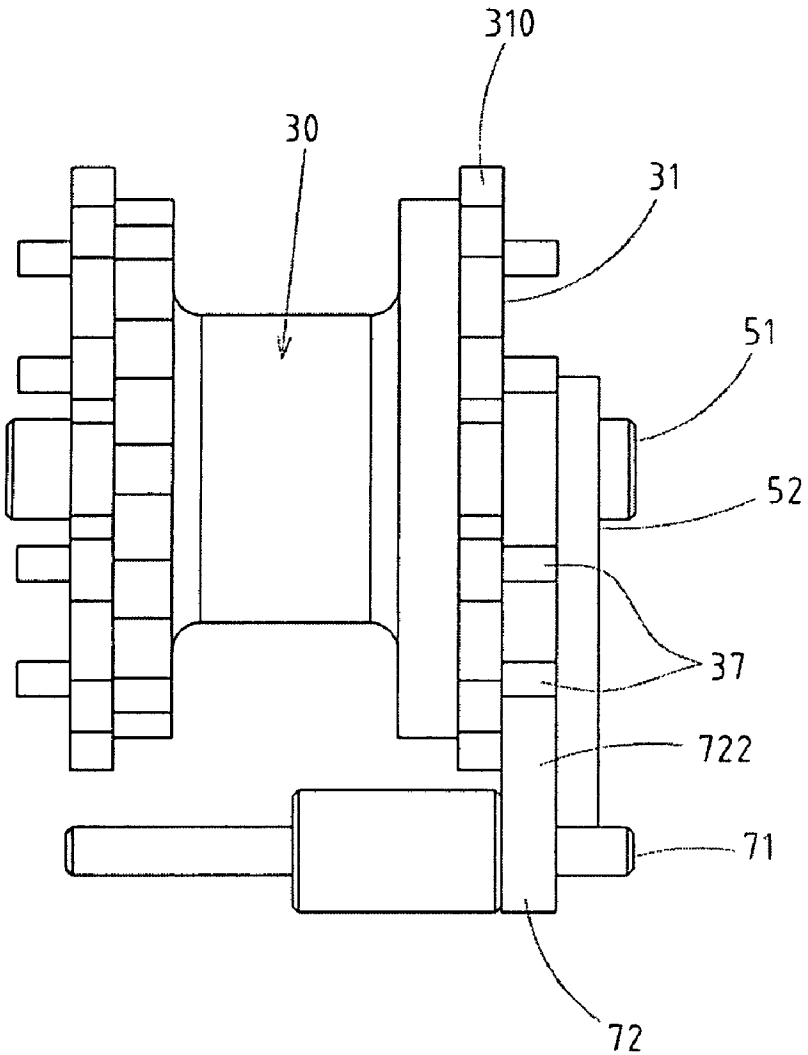
FIG. 8 shows a front elevation view of another embodiment of the blockage fixer of the present invention.

When the second protruding fastener 722 of the blockage fixer 70 disclosed in the present invention is pushed against the gear wheel 31, besides it can be pushed against the protruding teeth 310 of the gear wheel, several protruding column 37 can be placed on one side of the gear wheel 31 as shown in FIGS. 8 and 9, so that the second protruding fastener 722 on the blockage fixer 70 mentioned above can be pushed against the protruding column 37 mentioned earlier, and by so done to block the rotary driver 30.

Figure 10:
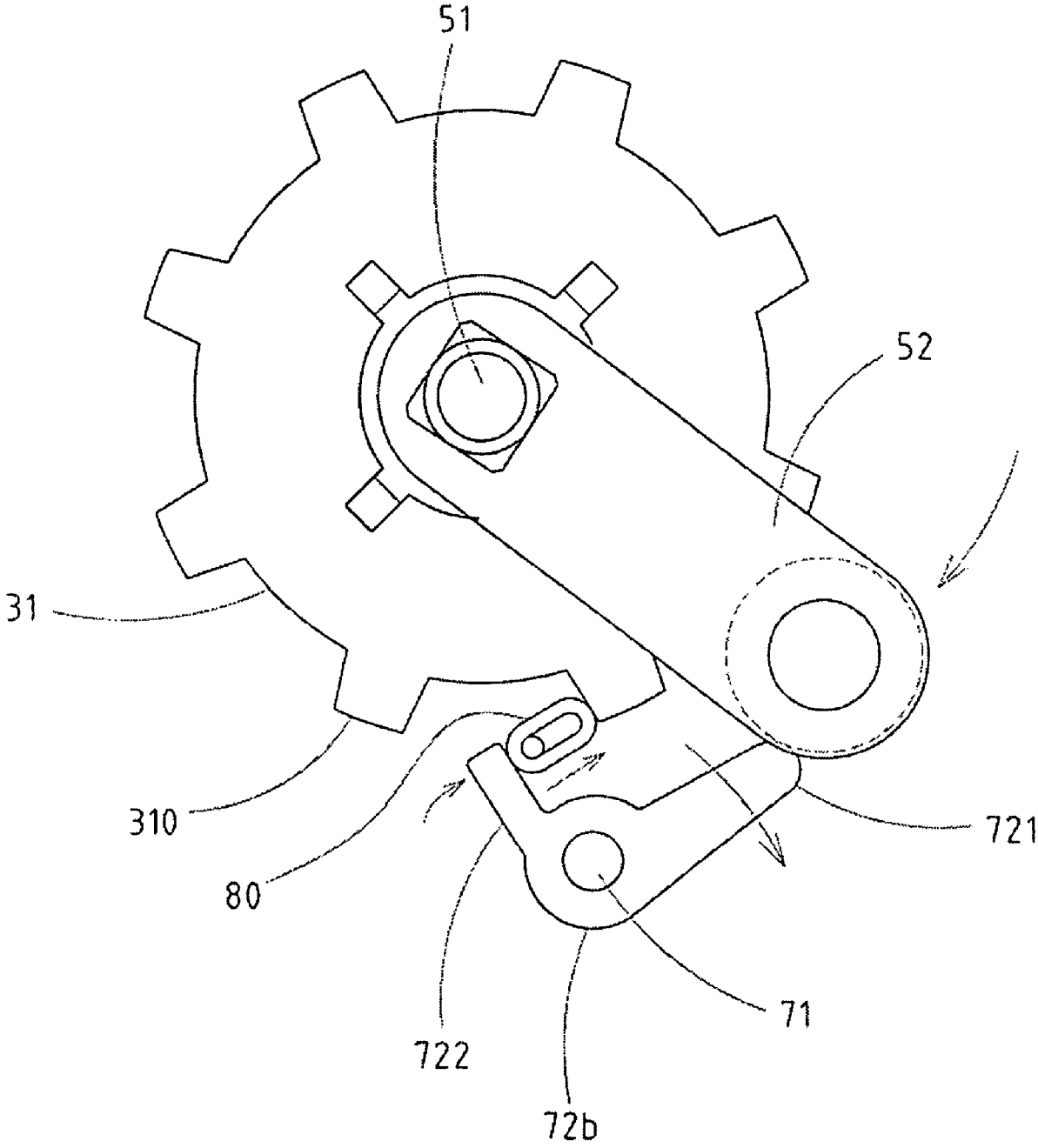
FIG. 10 shows a schematic view of another embodiment of the structure of the blockage fixer of the present invention.

Also, the structural position of the blockage fixer 70 disclosed in the present invention using the second protruding fastener 722 to push against the gear wheel 31 directly is not the absolute, only embodiment, it also has other alternative embodiment as shown in FIG. 10; the first protruding fastener 721 and the second protruding fastener 722 on each end of the fixation block 72B disclosed in the figure are located in vertical angle, and the protruding fastener 722 does not have direct contact with the space between the protruding teeth 310 of the gear wheel 31, instead, it has a slippery block 80 placed between them, and the slippery block is moving in the fixed direction on a track, and by so doing, when the first protruding fastener 721 is pushed against by the oscillation component 52 of the one-way driving component, the fixation block 72B is rotating using pivotal column 71 as point of support, so that it pushes the second protruding fastener 722 against the slippery block 80 to block the protruding teeth 310 of the gear wheel 31.

I claim:

1. A screw nailer apparatus comprising:

a body having a functional space therein;

a rotary driver positioned rotatably within said functional space, said rotary driver having a gear wheel and a plurality of fixation rims;

a nail belt drivedly connected to said gear wheel;

a one-way driving means having a guide rod and an oscillator, said guide rod linked to rotary driver for rotating said rotary driver in a single direction and for moving said oscillator at a preset angle synchronously;

an indexing fixing having an elastic wedge that is lockable into at least one of said plurality of fixation rims when said rotary driver is rotating in a direction with the preset angle;

a blockage fixer means drivably connected by an oscillating movement of said oscillator, said blockage fixing means for preventing said rotary driver from angularly turning such that the screw can be nailed by rotational inertia when said rotary driver is rotating.

2. The apparatus of claim 1, said one-way driving means having a one-way bearing, said one-way bearing placed on an outside of said guide rod and in an axial hole of said rotary driver.

3. The apparatus of claim 1, said indexing fixer being an L-shaped snap, said L-shaped snap having a coiled end that forms said elastic wedge.

4. The apparatus of claim 1, the fixation rim having an inverse slot formed between are blocks.

5. The apparatus of claim 1, said blockage fixing means having a pivotal column and a fixation block, said fixation block located on one side of said rotary driver and having a first protruding fastener and a second protruding fastener, said first protruding fastener positioned against said oscillator while oscillating such that said second protruding fastener is pushed against teeth on said gear wheel.

6. The apparatus of claim 5, said fixation column positioned in said functional space of said body, said fixation column located on one side of said fixation block such that said second protruding fastener is pushed against said fixation column so as to prevent said fixation block from turning.

* * * * *